US005208415A

United States Patent [19]

Sato

[11] Patent Number: 5,208,415

[45] Date of Patent: May 4, 1993

[54] FLUCTUATION GENERATOR FOR USE IN ELECTRONIC MUSICAL INSTRUMENT

[75] Inventor: Yasushi Sato, Hamamatsu, Japan

[73] Assignee: Kabushiki Kaisha Kawai Gakki Seisakusho, Japan

[21] Appl. No.: 662,770

[22] Filed: Feb. 28, 1991

[30] Foreign Application Priority Data

Feb. 28, 1990 [JP] Japan ..... 2-45486

[51] Int. Cl.[5] ..... G10H 7/00; G10H 1/02; G10H 5/00

[52] U.S. Cl. ..... 84/629; 84/662

[58] Field of Search ..... 84/601, 604, 624, 626, 84/629, 662, 701, 705, 706

[56] References Cited

U.S. PATENT DOCUMENTS

| | | | |
|---|---|---|---|
| 3,711,620 | 1/1973 | Kameoka et al. | 84/706 |
| 3,749,837 | 7/1973 | Doughty | 84/706 |
| 3,919,648 | 11/1975 | Vetrecht | 84/700 |
| 4,026,180 | 5/1977 | Tomisawa et al. | 84/629 |
| 4,327,419 | 4/1982 | Dentsoh et al. | 364/717 |
| 4,348,931 | 9/1982 | Wade | 84/632 |
| 4,622,877 | 11/1986 | Strong | 84/604 |

*Primary Examiner*—William M. Shoop, Jr.
*Assistant Examiner*—Jeffrey W. Donels
*Attorney, Agent, or Firm*—Bruce L. Adams; Van C. Wilks

[57] ABSTRACT

A fluctuation generator for use in an electronic musical instrument comprises uniform random generator for generating a random number having a uniform probability distribution, and a function circuit, which receives the random number from the uniform random generator and produces a random number MOD having a probability distribution according to a predetermined function. The function circuit may be constituted by a ROM. The fluctuation generator generates a tone signal in accordance with the random number MOD from the function circuit.

According to this fluctuation generator, the uniform random generator generates a random number having a uniform probability distribution, and sends it to the function circuit. The function circuit generates a random number in accordance with a function having a predetermined input/output characteristic to thereby generate a random number having a probability distribution close to the natural distribution (for example, a random number with the normalized distribution). A tone signal will be generated in accordance with this random number (for example, by adding the random number to a wave read frequency). A musical tone generated based on this tone signal should have fluctuation closer to the natural one.

25 Claims, 12 Drawing Sheets

FLUCTUATION GENERATOR FOR USE IN ELECTRONIC MUSICAL INSTRUMENT

BACKGROUND OF THE INVENTION

1. Field of the Invention

The present invention relates to a fluctuation generator for use in an electronic musical instrument, such as an electronic piano or electronic organ. More particularly, this invention pertains to a fluctuation generator that applies distortion, by which man can feel fluctuation, to a tone signal generated from a tone generator.

2. Description of the Related Art

Recently, active application of electronics to musical instruments, such as piano and organ, is producing many an electronic musical instruments, such as electronic piano and electronic organ. Such an electronic musical instrument has a tone generator to sequentially read out tone waveform data stored in advance in a memory to produce tone signals.

Musical tones which are generated when an acoustic musical instrument is played by a man, always contain natural, not mechanical, fluctuation. In other words, there actually exists no musical performance which involves fluctuation in the tone pitch, amplitude, timbre, tempo, and the like.

However, music performed by conventional electronic musical instruments, a digital electronic musical instrument in particular, does not produce such fluctuation. It is therefore difficult for electronic musical instruments to play music with fluctuation similar to the one created by acoustic musical instruments.

As a solution to this shortcoming, there is an expensive an optional specially-designed device which needs complex operations.

SUMMARY OF THE INVENTION

It is therefore an object of the present invention to overcome the conventional problem and to provide a fluctuation generator which, when used in an electronic musical instrument, allows the musical instrument to give natural musical performance containing fluctuation.

To achieve this object, as shown in FIG. 1, according to one aspect of the present invention, a fluctuation generator for use in an electronic musical instrument comprises uniform random generating means 1 for generating a random number $a_0$ having a uniform probability distribution, and a function circuit 2, which receives the random number $a_0$ from the uniform random generating means 1 and produces a random number MOD having a probability distribution according to a predetermined function. The fluctuation generator generates a tone signal in accordance with the random number MOD from the function circuit 2.

According to this fluctuation generator, the uniform random generating means 1 generates a random number $a_0$ having a uniform probability distribution, which presents a probability density curve as shown in FIG. 4A, and sends it to the function circuit 2. The function circuit 2 in turn generates a random number MOD in accordance with a function as represented by, for example, an input/output characteristic diagram 4 (input value on the horizontal scale and output value on the vertical scale) in FIG. 1 to thereby generate a random number having a probability distribution close to the natural distribution (for example, a random number with the normalized distribution), as shown in FIG. 4B.

A tone signal will be generated in accordance with this random number, for example, by adding the random number to a wave read frequency. A musical tone generated based on this tone signal should have fluctuation closer to the natural one. In FIGS. 4A and 4B, the horizontal scale X represents the probability factor while the vertical scale P(X) is the probability of occurrence.

According to another aspect of the invention to achieve the object, as shown in FIG. 2, a fluctuation generator comprises memory means 5 for storing a random number $a_1$ for selection of one function from multiple functions, uniform random generating means 1 for generating a random number $a_0$ having a uniform probability distribution, a function circuit 6, which receives the random number $a_0$ from the uniform random generating means 1 as well as the random number $a_1$ from the memory means 5 and produces a random number MOD having a probability distribution according to the single function determined by the random number $a_1$ from the memory means 5. The fluctuation generator processes a tone signal in accordance with the random number MOD from the function circuit 6 and generates a tone signal having fluctuation.

According to this fluctuation generator, the uniform random generating means 1 generates a random number $a_0$ with a uniform probability distribution, which has a probability density curve as shown in FIG. 4A, and sends it to the function circuit 6. The function circuit 6 also receives a random number $a_1$ from the memory means 5. The function circuit 6 generates a random number MOD in accordance with one function, selected from among multiple functions prepared in advance according to the content $a_1$ of the memory means 5, for example, the one represented by an input/output characteristic diagram 7 (input value on the horizontal scale and output value on the vertical scale) in FIG. 2. Accordingly, a random number having a probability distribution close to the natural distribution, as shown in FIG. 5 is generated. This random number MOD is stored as the next function select data in the memory means 5 as well as is added to a waveform read frequency. The resultant data is used to access the tone generator to generate a tone signal. Through the above processing, a tone signal will be released not only based on the random number $a_0$ from the uniform random generating means 1, but also according to the random number which has been generated in the previous sound release, thus giving the sounds fluctuation close to the natural one. Referring to FIG. 5, like those in FIGS. 4A and 4B, the horizontal scale X represents the probability factor while the vertical scale P(X) is the probability of occurrence.

According to a further aspect of the invention, as shown in FIG. 3, a fluctuation generator comprises N memory means $8_1$ to $8_N$ (N: any integer), connected in a series-shiftable manner, for respectively storing random numbers $a_1$ to $a_N$ for selection of one function from multiple functions, uniform random generating means 1 for generating a random number $a_0$ having a uniform probability distribution, a function circuit 9, which receives the random number $a_0$ from the uniform random generating means 1 as well as the random numbers $a_1$ to $a_N$ from the N memory means $8_1$–$8_N$ and produces a random number MOD having a probability distribution according to a single function determined by those random numbers $a_1$ to $a_N$ from the memory means $8_{1-N}$. The fluctuation generator processes a tone signal in accordance with the random number MOD from the function circuit 9 and generates a tone signal having fluctuation.

According to this fluctuation generator, the uniform random generating means 1 generates a random number $a_0$ with a uniform probability distribution, which provides a probability density curve as shown in FIG. 4A, and sends it to the function circuit 9. The function circuit 6 also receives a random number $a_1$ from the memory means $8_1$–$8_N$. The function circuit 9 generates a random number MOD in accordance with one function, selected from multiple functions (not shown) prepared in advance according to the contents $a_1$–$a_N$ of the respective memory means $8_1$–$8_N$. Accordingly, a random number having a probability distribution close to the natural distribution. This random number MOD is stored as the next function select data in one of the memory means, $8_1$, through a shifting operation. Information stored in the memory means $8_1$ to $8_{N-1}$ is shifted one by one to the subsequent memory means $8_2$ to $8_N$. The random number MOD from the function circuit 9 is added to a waveform read frequency, for example. Based on the resultant data, the tone generate is accessed to generate a tone signal. Through the above processing, a tone signal will be released not only based on the random number $a_0$ from the uniform random generating means 1, but also according to the random numbers which have been generated in the sound release conducted in the previous N cycles, thus giving the sounds fluctuation close to the natural one.

DETAILED DESCRIPTION OF THE PREFERRED EMBODIMENTS

Preferred embodiment of the present invention will now be described referring to the accompanying drawings.

Figure 1:
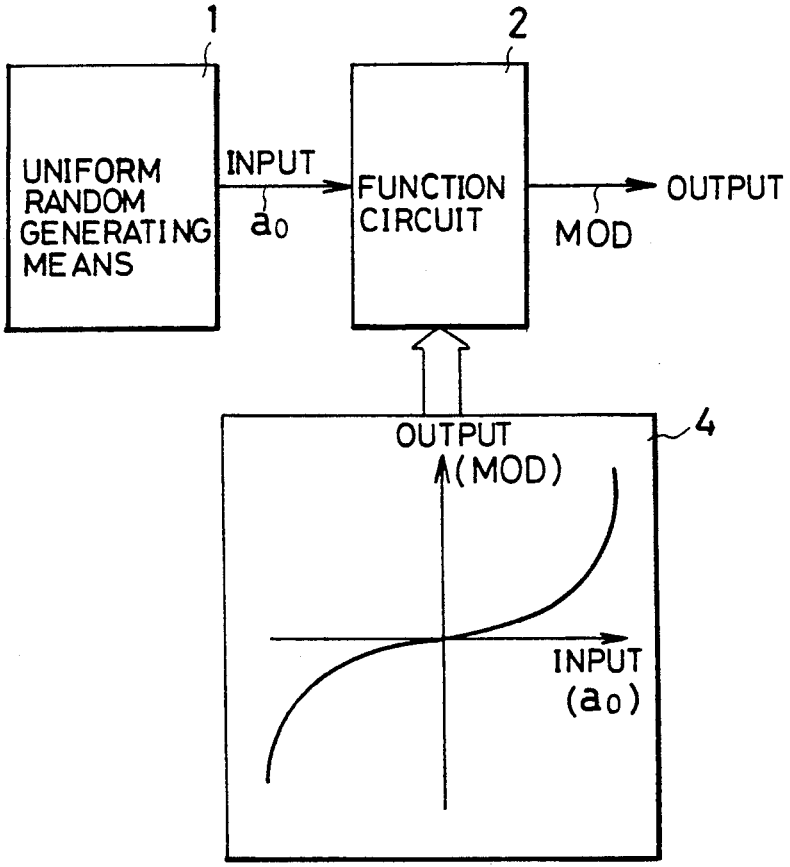
FIG. 1 is a block diagram illustrating the structure of the first invention.
Figure 2:
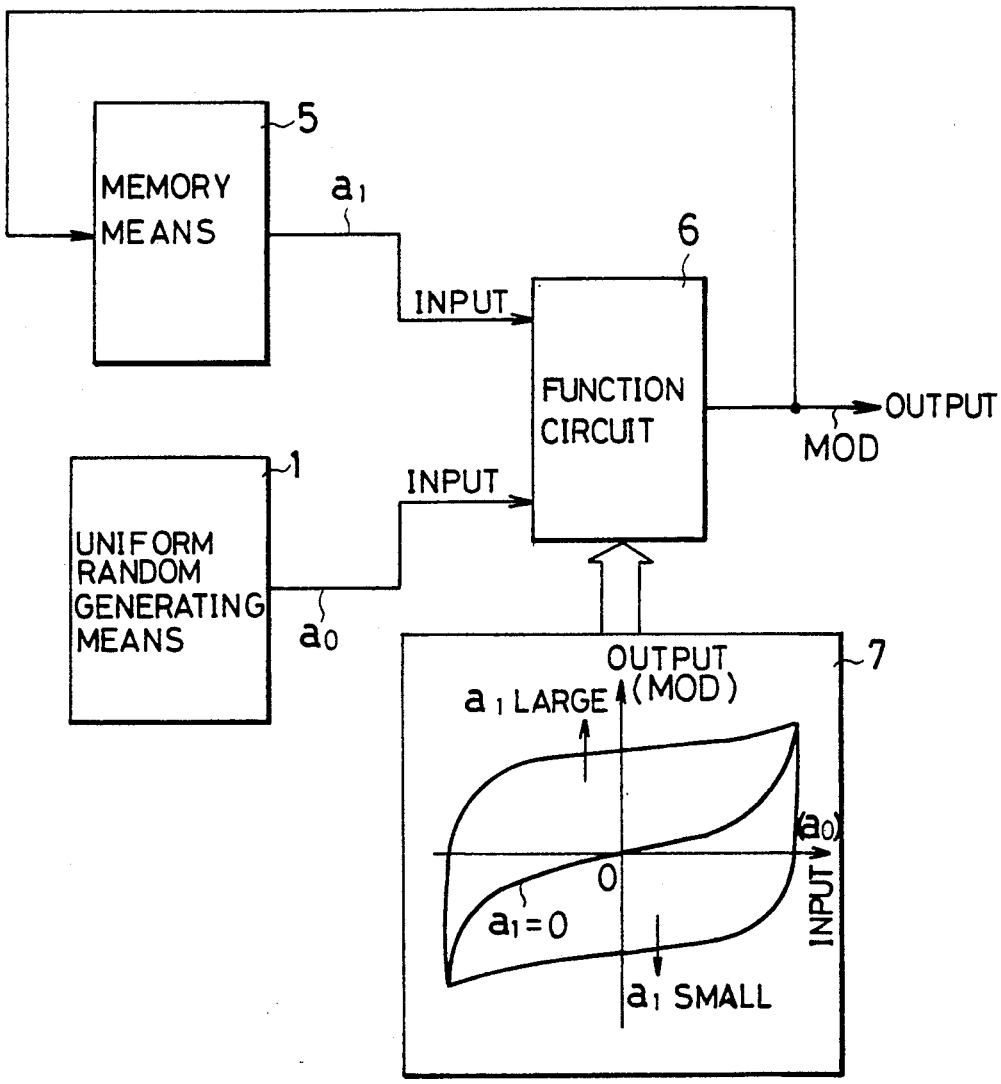
FIG. 2 is a block diagram illustrating the structure of the first invention.
Figure 3:
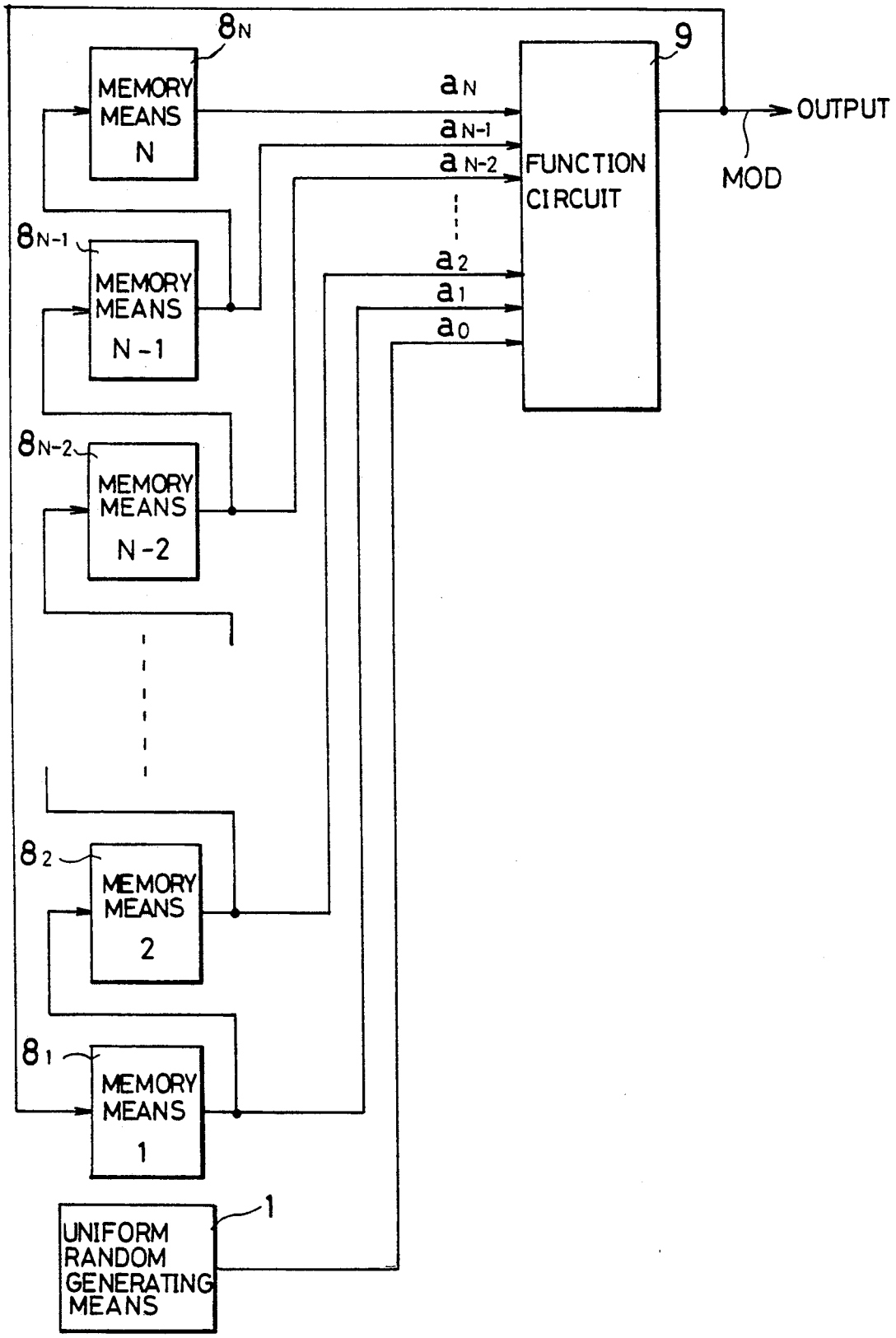
FIG. 3 is a block diagram illustrating the structure of the first invention.
Figure 4A:
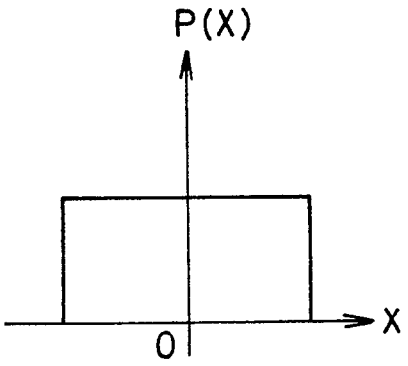
FIG. 4A is a diagram showing a probability distribution of random numbers output from uniform random generating means.
Figure 4B:
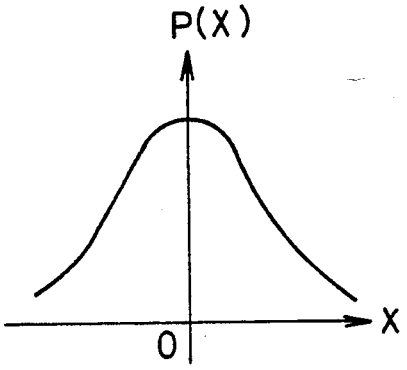
FIG. 4B is a diagram showing a probability distribution of random numbers output from a function circuit according to the first invention.
Figure 5:
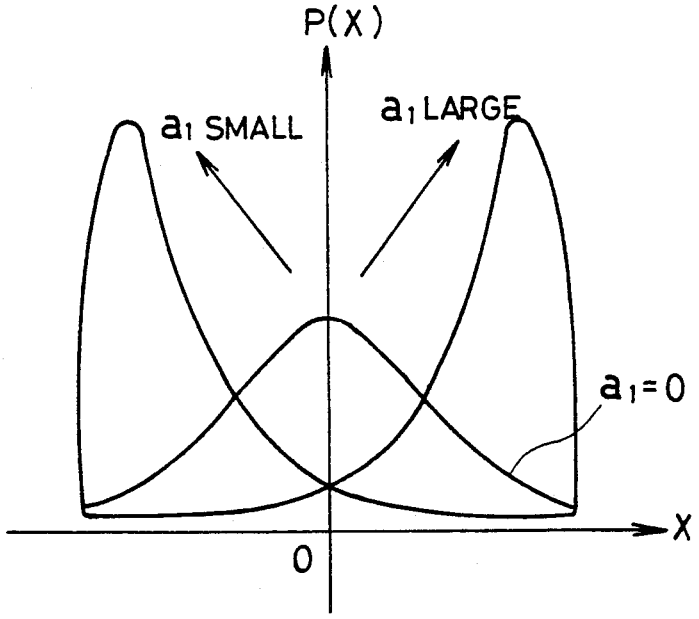
FIG. 5 is a diagram showing a probability distribution of random numbers output from a function circuit according to the second invention.
Figure 6:
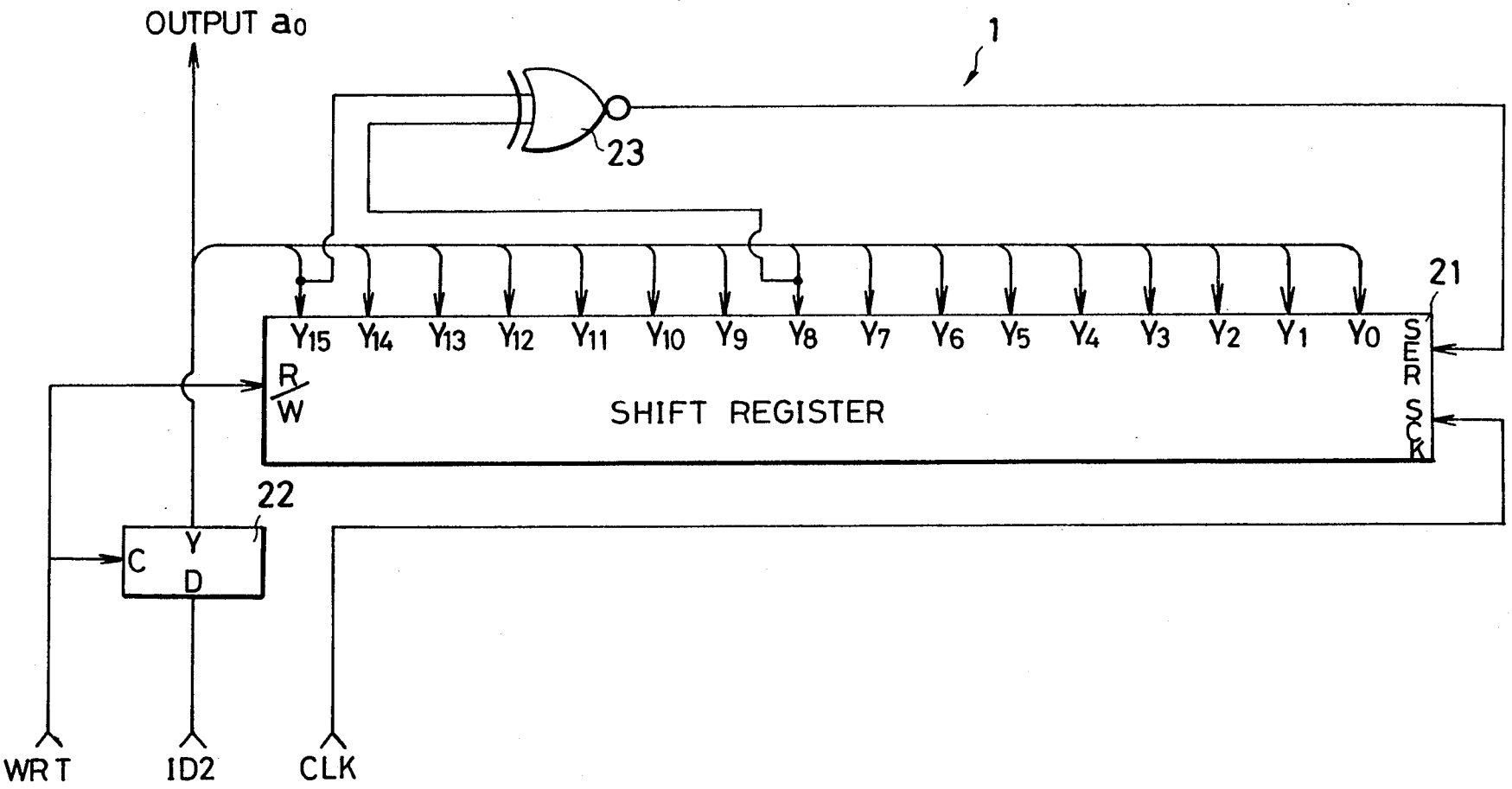
FIG. 6 is a circuit diagram depicting the structure of an embodiment of uniform random generating means.

FIG. 6 presents a circuit diagram illustrating one embodiment of a uniform random generator as uniform random generating means 1, which is commonly used in the inventions shown in FIGS. 1 through 3. The uniform random generator 1 generates random numbers in the probability distribution represented by the probability density curve shown in FIG. 4A. This generator 1 includes a 16-bit shift register 21 capable of doing parallel read/write operations, a tristate buffer 22 and a circuit for acquiring an inverted output of an exclusive NOR (this circuit hereinafter will be referred to as "EXNOR circuit"), connected in the illustrated manner.

The shift register 21 has sixteen I/O common terminals $Y_0$ to $Y_{15}$, and serves to receive and store externally-input data and output stored data in accordance with the level of a signal supplied to its R/W terminal.

The shift register 21 performs the shift operation in response to a clock signal CLK given to an SCK terminal. In executing the shift operation, a signal applied to an SER terminal becomes shift-in data. Data shifted out by the shift operation will disappear.

The tristate buffer 22 serves to control the transfer permission/inhibition of data ID2 supplied externally. The output of this tristate buffer 22 is supplied to the I/O common terminals $Y_0$–$Y_{15}$ of the shift register 21. Two signals coming from the I/O common terminals $Y_8$ and $Y_{15}$ are supplied to the EXNOR circuit 23, which performs an exclusive-OR operation of the input signals, then inverts the resultant signal. The output of the EXNOR circuit 23 is supplied to the SER terminal of the shift register 21.

The operation of the uniform random generator 1 will be described below. When a write signal WRT externally supplied becomes a low (L) level, the tristate buffer 22 becomes active, permitting the externally-supplied data ID2 to pass through to the I/O common terminals $Y_0$–$Y_{15}$. At this time, with the R/W terminal of the shift register 21 at an L level, the shift register 21 enters a write mode, and stores the data supplied to the I/O common terminals $Y_0$–$Y_{15}$. When the write signal WRT becomes a high (H) level, the tristate buffer 22 disables the transfer of the externally-supplied data ID2, providing an output of high impedance. Since the H-level signal, WRT, is also supplied to the R/W terminal of the shift register 21, the register 21 goes to a read mode, sends the stored content from the I/O common terminals $Y_0$–$Y_{15}$. The output of the shift register 21 becomes an output $a_0$ of the uniform random generator 1. When the clock signal CLK is supplied to the SCK terminal of the shift register 21 under that condition, the shift operation is executed in synchronism with the clock signal CLK. At the time of executing the shifting operation, the SER terminal of the shift register 21 is applied as shift input data with the output signal of the EXNOR circuit; this signal is acquired by inversion of the result of an exclusive-OR operation on the outputs of the terminals $Y_8$ and $Y_{15}$.

Through the above operation, every time the clock signal CLK is input, a uniform random number $a_0$ is generated and output.

First Embodiment

Figure 7:
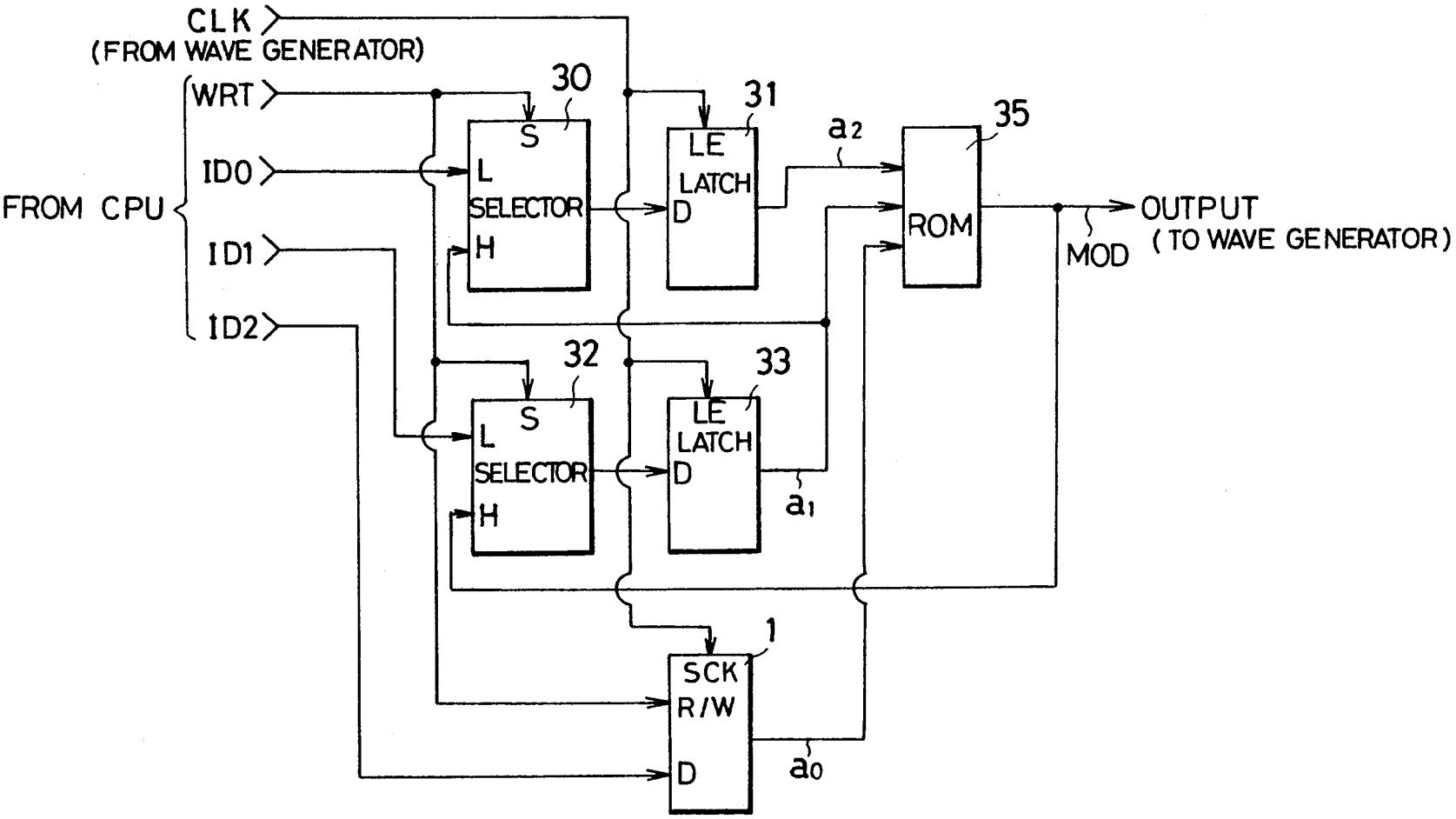
FIG. 7 is a block diagram showing the structure of the first embodiment of a fluctuation generator according to the present invention.

FIG. 7 illustrates the first embodiment of the fluctuation generator, which comprises selectors 30 and 32, latches 31 and 33, a ROM 35 and the uniform random generator 1 connected in the illustrated manner. This embodiment encompasses the three inventions respectively shown in FIGS. 1 through 3.

The invention shown in FIG. 1 is realized by the uniform random generator 1 and the ROM 35 serving as the function circuit 2. The invention shown in FIG. 2 is realized by the uniform random generator, the latch 33 as the memory means 5, and the ROM 35 as the function circuit 6. The invention shown in FIG. 3 is realized by the uniform random generator 1, the latch 33 as the memory means $8_1$, the latch 31 as the memory means $8_2$, and the ROM 35 as the function circuit 9. In the last case, N, the number of memory means in use, is two.

Referring to FIG. 7, the selector 30 selects either an input from the L input terminal or the one from the H input terminal in accordance with the write signal WRT from a CPU 51 (which will be described later), then outputs the selected signal. This output is supplied to the latch 31. The selector 30 receives data ID0 at the L input terminal and receives the output of the latch 33 at the H input terminal; the data ID0 from the CPU 51 is initial data to be set in the latch 31.

The latch 31 temporarily stores the output of the selector 30 in synchronism with the clock signal CLK from a wave generator 59. The output of the latch 31 sent as an upper address $a_2$ to the ROM 35.

Likewise, the selector 32 selects either an L-side input or an H-side input in accordance with the write signal WRT. This output is supplied to the latch 33. The selector 32 receives data ID1 from the CPU 51 at the L input terminal and receives the output of the ROM 35 at the H input terminal; the data ID1 is initial data to be set in the latch 31.

The latch 33 temporarily stores the output of the selector 32 in synchronism with the clock signal CLK from the wave generator 59. The output of the latch 33 sent as a middle address $a_1$ to the ROM 35.

The uniform random generator 1, identical to the one shown in FIG. 6, sets the data ID2 or an initial value in the shift register 21 in accordance with the write signal WRT, and generates uniform random numbers through the above-described operation thereafter every time it receives the clock signal CLK. The uniform random generator 1 supplies each generated random number as a lower address $a_0$ the ROM 35.

The ROM 35 is a read only memory having data of multiple function curves stored therein. A specific function curve is selected with the upper address $a_2$ and the middle address $a_1$. The lower address $a_0$, a random number generated from the uniform random generator 1, is converted into a random number having a predetermined probability distribution in accordance with the selected function curve, then it is output. In the function circuit 2 shown in FIG. 1, data about the function curve indicated by the input/output characteristic diagram 4 is stored, and in the function circuit 6 shown in FIG. 2, data about the function curve indicated by the input-/output characteristic diagram 7 is stored. Further, in the function circuit 9 shown in FIG. 3 is stored data of function curves representing more complex input/out characteristics (not shown).

The operation of this embodiment will now be discussed. First, the write signal WRT is set to an L level to initialize the storage statuses of the latches 31 and 33 and that of the uniform random generator 1. As a result, the L input of each of the selectors 30 and 32 becomes active or is selected, and initial data ID0 and ID1 are respectively supplied to the latches 31 and 33. Initial data ID2 is supplied through the tristate buffer 22 to the shift register 21 of the uniform random generator 1. Under the conditions, upon reception of the clock signal CLK, the latches 31 and 33 and the shift register 21 hold their initial data ID0, ID1, and ID2 therein.

Then, when the initialization is completed and the write signal WRT becomes an H level, data $a_2$, $a_1$ and $a_0$ are output respectively from the latches 31 and 32 and the uniform random generator 1 and supplied as an address to the ROM 35. Consequently, a random number corresponding to the address is output from the ROM 35. This random number is sent to the H input terminal of the selector 32 as well as to an external unit (wave generator 59). At this time the selectors 30 and 32 have their H inputs active, so that the output of the latch 33 is supplied to the input terminal D of the latch 31 while the output of the ROM 35 is applied to the input terminal D of the latch 33. When the clock signal CLK is input under the above conditions, the output of the latch 33 is set to the latch 31, and the output of the ROM 35 to the latch 33. These inputs are supplied as new addresses $a_2$ and $a_1$ to the ROM 35. At the same time the uniform random generator 1 generates a new random number which is supplied as an address $a_0$ to the ROM 35.

Thereafter, upon every input of the clock signal CLK, a new random number will be generated and output therefrom.

Second Embodiment

Figure 8:
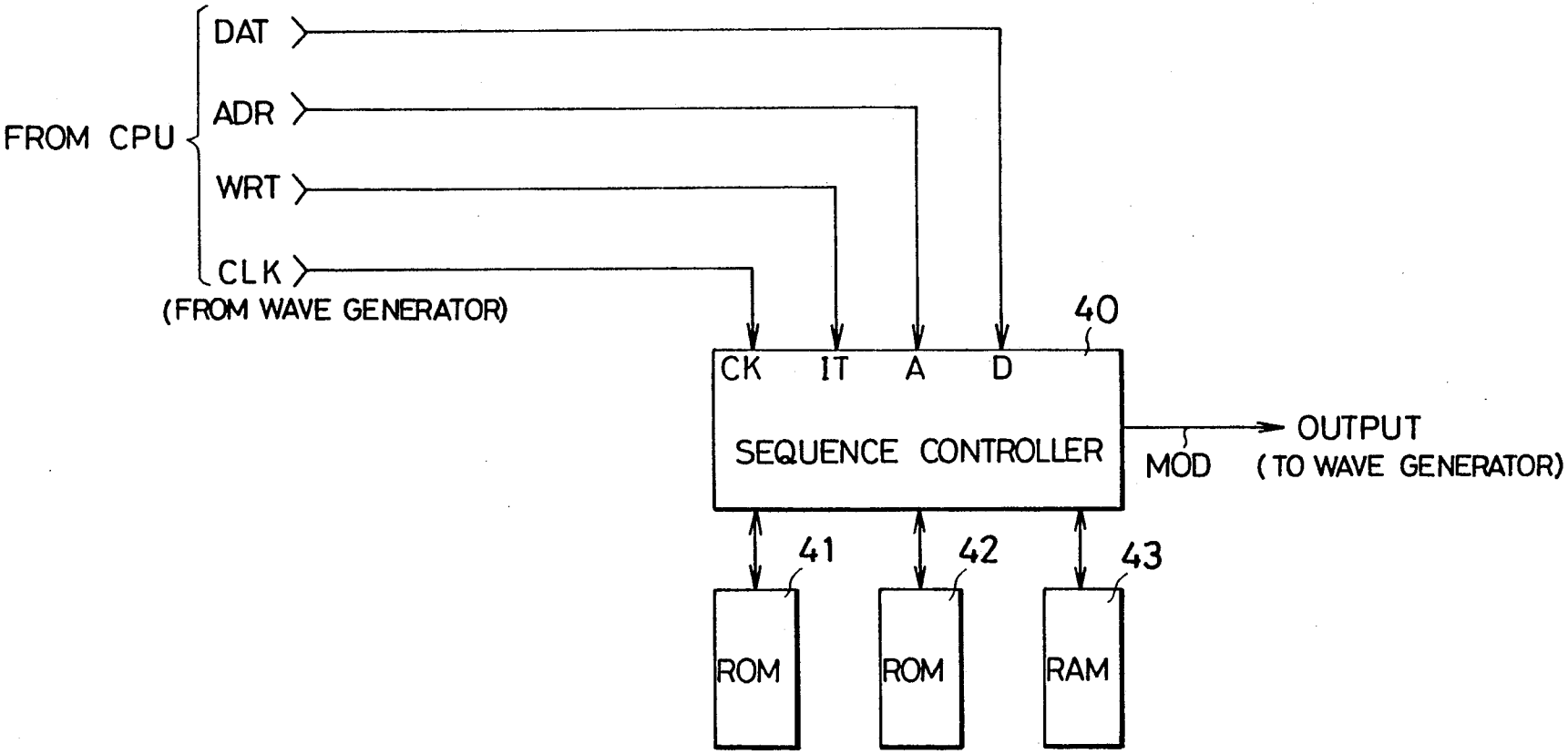
FIG. 8 is a block diagram showing the structure of the second embodiment of a fluctuation generator according to the present invention.

FIG. 8 illustrates the second embodiment of the fluctuation generator. The following description will be given with reference to the case of realizing the same function as that of the first embodiment shown in FIG. 7.

Referring to FIG. 8, a sequence controller 40, constituted by a digital signal processor or the like, is connected with ROMs 41 and 42 and a RAM 43.

The ROM 41 holds a program to operate the sequence controller 40.

The ROM 42 holds data of multiple function curves, and corresponds to the ROM 35 in FIG. 7.

The RAM 43 is a work memory which is used by the sequence controller 40 for temporary storage of the necessary data. More specifically, the RAM 43 has memory areas allocated for a channel counter for storing the channel number of a channel presently in use (or presently generating tones), an upper address register MO (equivalent to the latch 31 in FIG. 7), a middle address register Ml (equivalent to the latch 33 in FIG. 7), a lower address register Mr (equivalent to the shift register 21 in FIG. 6), and a temporary register TR for temporary storage of data read out from the ROM 42, etc.

The sequence controller 40 has a clock input terminal CK, an interrupt input terminal IT, an address input terminal A and a data input terminal D, which respectively receive the clock signal CLK from the wave generator 50 (to be described later), write signal WRT, address ADR and data DAT. The last three are supplied from the CPU 51 (to be described later).

Figure 9:
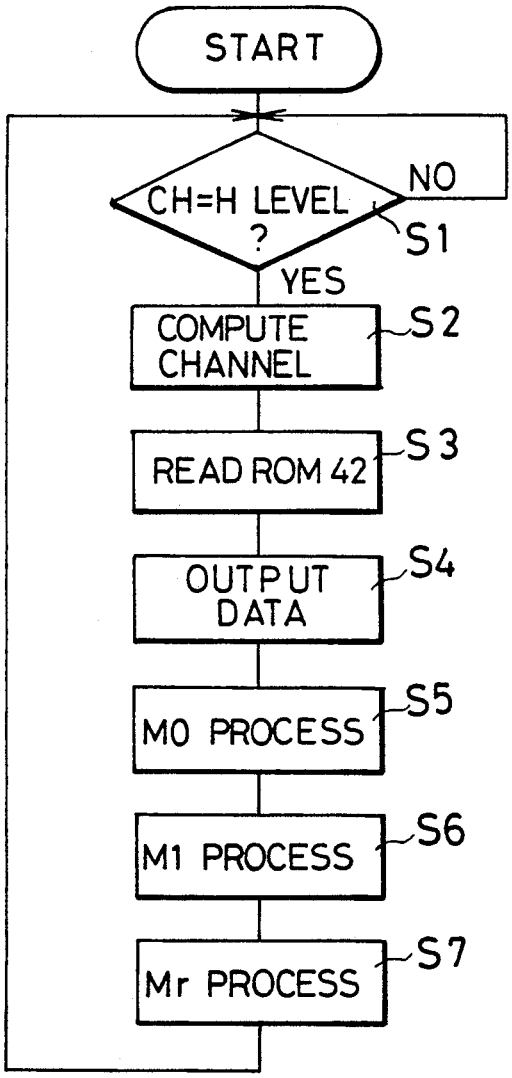
FIGS. 9 and 10 present flowcharts for explaining the operation of the second embodiment in FIG. 8.
Figure 10:
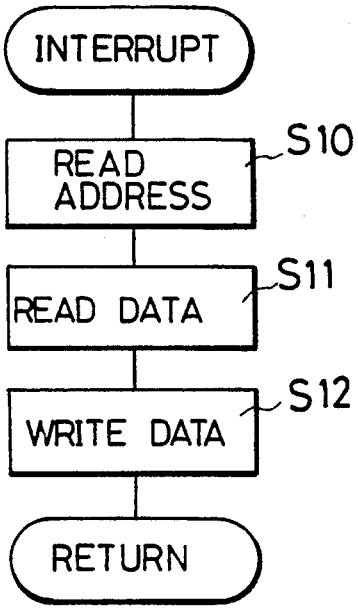

The operation of the second embodiment structured above will be now explained referring to the flowcharts in FIGS. 9 and 10.

In step S1, it is checked if the clock signal CLK received at the clock input terminal CK becomes an H level, i.e., whether or not the clock is input, and the apparatus waits for the clock input, doing the check (step S1). When it is judged that the clock is received in this hold state, a channel computing process is executed (step S2). The channel computing process is to determine a channel that generates fluctuation in the following process. In this process, the channel counter area in the RAM 43 is incremented by "1" to update the channel number. If the resultant value exceeds the number of channels provided in the apparatus, processing is executed to reset the number to "0" is executed.

Subsequently, data is read out from the ROM 42 (step S3). More specifically, the contents of the upper address register MO, middle address register Ml and lower address register Mr are sent as address data to the ROM 42, and a random number corresponding to a function curve associated with the address is fetched in the sequence controller 40. The sequence controller 40 outputs the random number to an external unit (wave generator 59) as well as sets it to the temporary register TR (step S4).

The controller 40 then performs an MO process (step S5) which is to transfer the content of the middle address register Ml to the upper address register MO. Subsequently, the controller 40 executes an Ml process (step S6) which is to transfer the content of the temporary register TR to the middle address register Ml. Through the two processes MO and Ml, the function to shift generated random numbers is realized.

The controller 40 then executes an Mr process (step S7). This Mr process is for realizing a function equivalent to the function of the uniform random generator shown in FIG. 6. In other words, this is a function to acquire the exclusive OR of bits 15 and 8 of the lower address register Mr, invert the resultant value, then shift the content of the register Mr one bit to the left while setting the inverted value to the temporary register TR, and set the content of the register TR to the least significant bit (bit 0).

After a series of processes is over, the flow returns to step S1 to execute the same process as described above. As a result, synchronizing with a clock signal CLK, a random number, having a predetermined probability distribution, is generated one after another.

The sequence controller 40 is initialized by triggering the write signal WRT from the outside (CPU 51). In other words, when the write signal WRT is triggered and supplied to the interrupt input terminal IT of the sequence controller 40, the interrupt process shown in FIG. 10 starts.

In this process, the address ADR sent to the address input terminal A is read in (step S10). Then, data DAT sent to the data input terminal D is read in (step S11). The data DAT is written in the range of the RAM 43 designated by the address ADR, i.e., the range of the upper address register MO, the middle address register Ml, or the lower address register Mr. The above operations are executed in order for each of the registers MO, Ml, and Mr, initializing the sequence controller 40.

Figure 11:
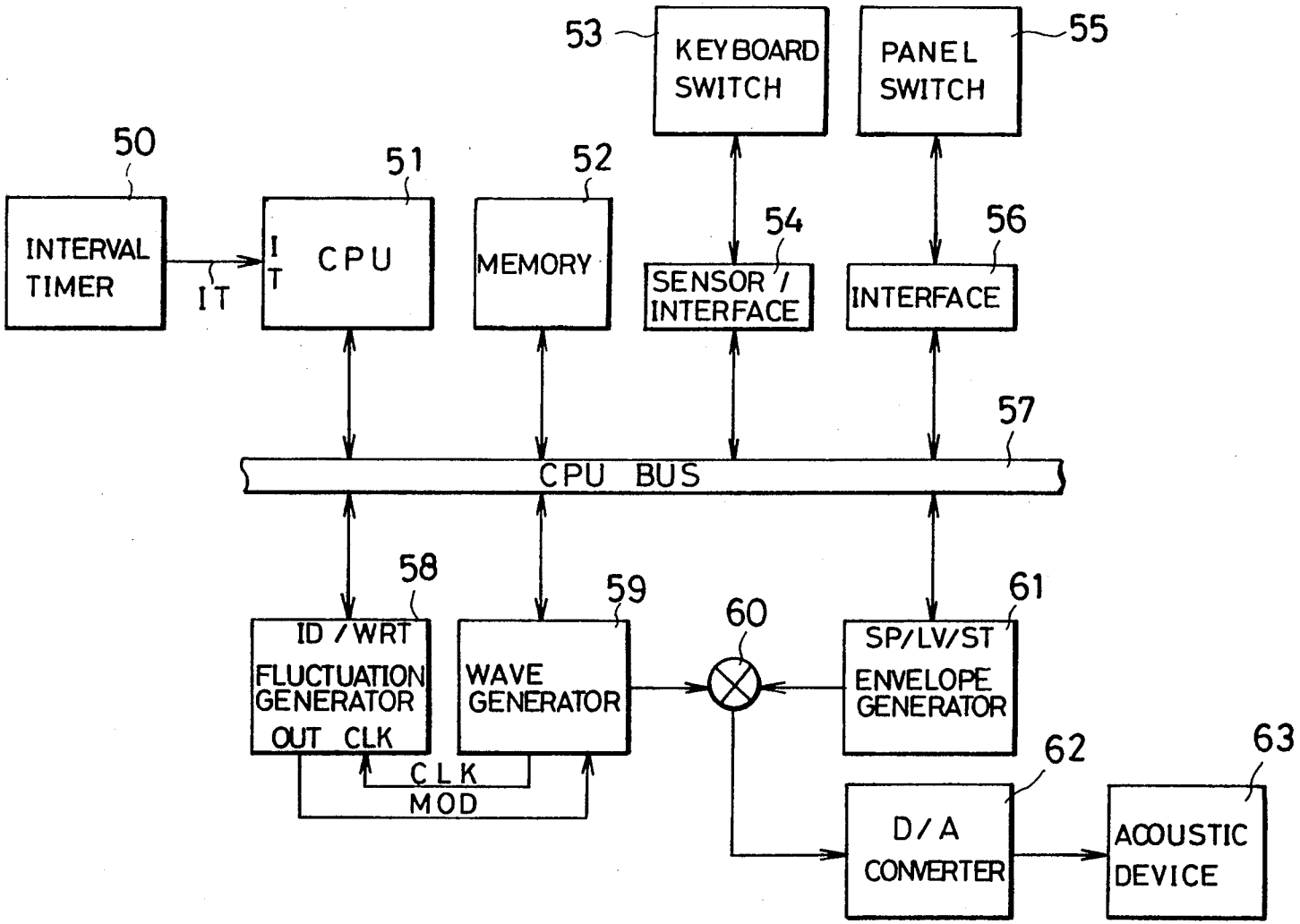
FIG. 11 is a block diagram illustrating the structure of an electronic musical instrument to which the fluctuation generator of the present invention is applied.

FIG. 11 is a block diagram illustrating the structure of the electronic music instrument to which the fluctuation generator of the present invention is applied.

An interval timer 50 generates an interrupt signal IT at time intervals in accordance with the data set in advance, supplying the signal to the CPU 51. Receiving the interrupt signal IT, the CPU 51 executes a predetermined interrupt process at certain intervals (the detail description will be followed).

Through a CPU bus 57, the CPU 51 reads a program that is stored in the program memory section of a memory 52, and controls each section of the electronic musical instrument according to this program.

The memory 52, comprising the ROM and RAM, has timbre data and other kinds of fixed data, besides programs for operating the CPU 51, and further includes a working area.

A keyboard switch 53 is a group of keyboard switches for transmitting the key-pressing/releasing operation by a performer. The information from the keyboard switch 53 will be sent to a sensor/interface 54.

The sensor/interface 54 includes a scan circuit (not shown) that scans the keyboard switch 53. The scan circuit 53 detects the number and tough data of key pressed or released, and supplies them through the CPU bus 57 to the CPU 51. The above touch data is to be generated in the well known tough detector (not shown).

A panel switch 55 is a group of switches, such as a power switch, a mode designating switch, a timbre selection switch, a rhythm selection switch, and effect switches of various type. A signal from the panel switch 55 is to be sent to an interface 56.

The interface 56 has a scan circuit for scanning the panel switch 55. The scan circuit detects a switch operated in the panel switch 55 and sends its switch number through the CPU bus 57 to the CPU 51.

The fluctuation generator of the first and second embodiments, shown in FIG. 7 or 8, is used also as a fluctuation generator 58 in this embodiment. The detail description of this generator is omitted as already given before.

A wave generator 59 generates a tone generation signal having fluctuation, in accordance with the data sent from the CPU bus 57, or the random number received from the fluctuation generator 58, supplying this signal to a multiplier 60. The wave generator will be explained more in detail later.

An envelope generator 61 produces an envelope signal which determines an amplitude of the tone generation signal according to envelope data sent from the CPU bus 57. The envelope signal from the envelope generator 61 is also to be sent to the multiplier 60.

The multiplier 60 multiplies the tone wave signal from the wave generator 59 by the envelope signal from the envelope generator 61 to generate a tone signal added the envelope. The addition with the envelope to the signal permits one to control dynamics and a sustaining time of sounds for releasing. The multiplier 60 sends the digital musical tone signal added the envelope to a D/A converter 62.

The D/A converter 62 converts the digital tone signal from the multiplier 60 to an analog tone signal, and supplies the signal to an acoustic device 63.

The acoustic device 63 converts the received analog signal, that is an electric signal, to an acoustic signal, releasing it by an acoustic generating means, such as a loudspeaker or a headphone.

Figure 12:
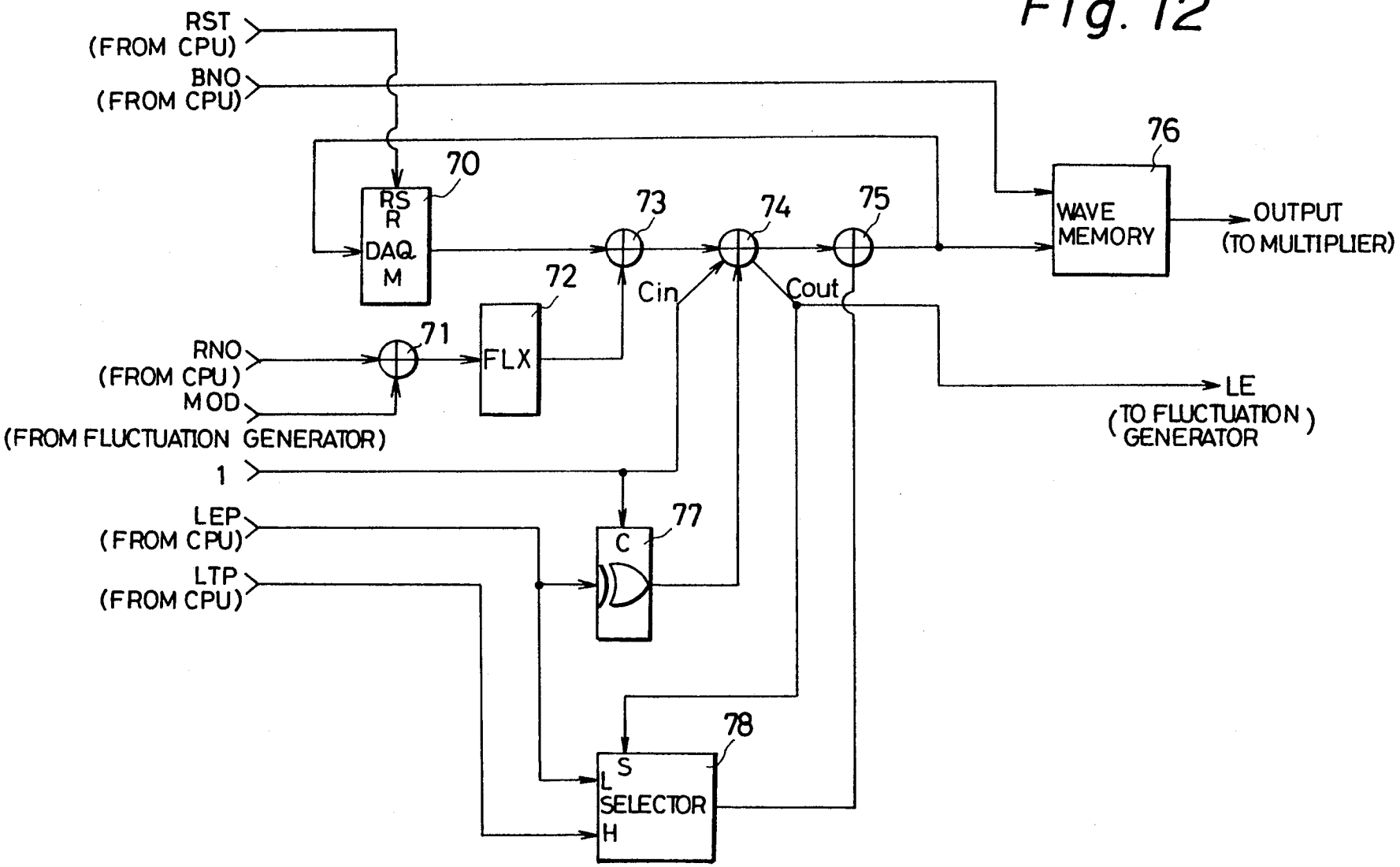
FIG. 12 is a block diagram showing the structure of a wave generator.

FIG. 12 shows one embodiment of the wave generator 59. A RAM 70 stores the output of an adder 75 during one time slot, and outputs the contents during the next time slot. The contents in the RAM 70 will be cleared according to a reset signal RST which is output from the CPU 51 at the beginning of tone generation.

The adder 71 adds a frequency number signal RNO received from the CPU 51 to a random number signal MOD from the fluctuation generator 58, supplying the resultant to a floating/fixed point transform circuit (hereafter referred to as "FLX") 72. The FLX 72 transforms the data expressed in a floating point form for handling data in a wider range to the data in a fixed point form. The output of this FLX 72 is to be supplied to an adder 73, which adds the contents of the RAM 70 to the output of the FLX 72 and sends the resultant to an adder 74.

The CPU 51 outputs a loop end signal and a loop top signal. When the range of a wave memory 76 is selected at random, the loop end signal LEP designates the end of the memory range, while the loop top signal LTP designates the head of the range. The adder 74 subtracts the loop end signal LEP from an output signal of the adder 73, or adds the output of the adder 73 to the complement of "2" of the loop end signal LEP. The adder 74 has the output from the adder 73 at its one of three input terminals, a signal normally as "1" applied to its carry input $C_{in}$, and a signal inverted from the loop end signal LEP in an inverter 77, i.e., the complement of "1" received to another input terminal, thus performs the subtraction.

The inverter 77 includes an exclusive OR (EXOR) circuit where a signal of being normally "1" is applied to one input terminal. The output of the adder 74 is received to the first input terminal of an adder 75.

If the addition in the adder 74 results in no carry output $C_{out}$ therefrom, a selector 78 selects the side L so that the loop end signal LED is supplied to the second input terminal of the adder 75. This adds the subtracted data to the input from the adder 74 for returning to the original state, and supplies the resultant to a wave memory 76.

If there is a carry output $C_{out}$ resulted from the by the adder 74, the selector 78 selects the side H, supplying the loop top signal LTP to the second input terminal. Therefore, the data external from the loop end is added and compensated to continuously read out the data designated by the loop top and loop end. A carry output $C_{out}$ signal is output from the LE terminal, serving as a clock signal CLK of the fluctuation generator 58.

The wave memory 76 stores musical tone wave data in advance, and reads the wave data, with a bank signal BNO, for roughly selecting the waveform from the CPU, as an upper address and the output from the adder 75 as a lower address. Then, the musical tone wave data is supplied as a digital musical tone wave signal to the above-described multiplier 60.

Figure 13:
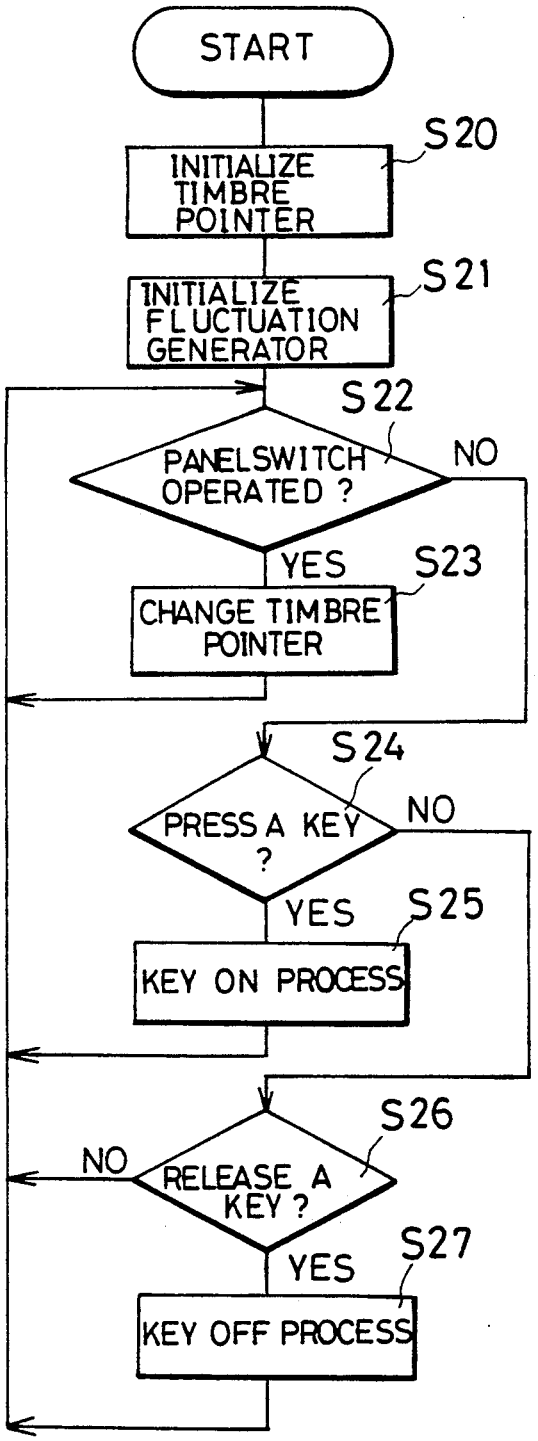
FIGS. 13 and 14 are flowcharts for explaining the operation of the electronic musical instrument shown in FIG. 11.

The operation of the electronic music instrument shown in FIG. 11 will now be explained referring to a flowchart in FIG. 13.

As the power is turned on or the operation resumes according to the reset operation, the timbre pointer is initialized (step S20). The timbre pointer that designated the timbre to be released is set to the initial value. The initial timbre data stored in the timbre table of the memory 52 which is designated by the timbre pointer is sent as the bank signal BNO to the wave generator 59.

Then, the fluctuation generator 58 is initialized (step S21). The musical instrument reads the initial value of the fluctuation data which is stored in the timbre table indicated by the timbre pointer, supplying its value to the fluctuation generator 58. Accordingly, the initial values ID0, ID1, and ID2 are set respectively in the latches 31 and 33, and the shift register 21 in the uniform random generating circuit 1 of the first embodiment shown in FIG. 7. In the second embodiment, the registers MO, Ml, and Mr in the RAM 43 are set to their initial values.

When the above initialization operation is over, the contents of the interface 56 is read in to determine if the panel switch 55 has been operated (step S22). When it is judged that the panel switch 55 has been operated, the timbre pointer is changed according to the operation contents. The initialized data for the fluctuation generator 58, which is set for each timbre, is read out of the timbre table indicated by this timbre pointer, and the fluctuation generator 58 is initialized (step S23).

When it is judged in step S22 that no operation is done with the panel switch 55, the contents of the interface 56 is read in to check if any key on the keyboard switch 53 has been pressed (step S24). When the key is judged as depressed, a KEY ON process is executed (step S25). This KEY ON process is for sending data associated with timbre, touch, and range to the fluctuation generator 58, the wave generator 59, and the envelope generator 61, thus releasing the musical tones from the acoustic device 63.

When it is judged that no key has been pressed in step S24, the sensor/interface 54 is read in to check if any key of the keyboard switch 53 is released (step S26). When it is judged that the key is released, a KEY OFF process is executed (step S27). The KEY OFF process is to send data in accordance with timbre, touch, and range, to the fluctuation generator 58, the wave generator 59, and the envelope generator 61, for commanding the end of a tone generation. This releases a musical tone from the acoustic device 63. The tone generation is not completely stopped in this case; reverberation associated with releasing the key occurs.

After a series of the processes described above is completed, the flow returns to step S22, and the above operation is repetitively executed. Accordingly, tones will be generated with fluctuation close to that of natural sounds or the tone generation will be stopped, while timbre is being changed in association with the operation of the panel switch 55 and the key-depression/-release of the keyboard switch 53.

Figure 14:
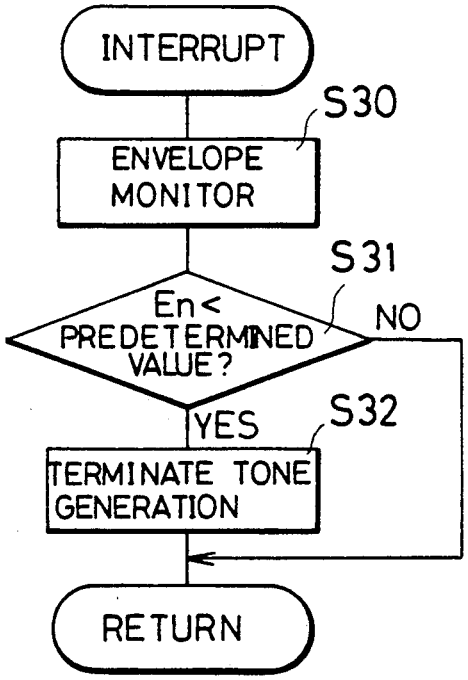

An interrupt routine in FIG. 14, independent of the above processes, is invoked to terminate the tone generation, in response to an interrupt signal IT of a certain cycle, which is generated from the interval timer 50. Upon receiving the interrupt signal IT to the CPU 51, the CPU 51 executes an envelope monitor process, which reads an updated envelope value En from the envelope generator 61 (step S30). It is determined whether or not the envelope value En is smaller than a predetermined value (step S31). When the value En is not smaller, no further process will be executed and the interrupt process routine is returned. In other words, it means that the musical tone with its value equal to or greater than the predetermined value is being released. When En is smaller than the predetermined value, a tone generation termination process will be executed (step S32). This process is to terminate the tone generation. When the musical tone being generated has a value lower than the predetermined value, tone generation is completely stopped.

As described above, the uniform random generating means generates a random number of a probability distribution according to a predetermined function, then a random number having a probability distribution according to a function reflecting the latest state, further a random number having a probability distribution of a function reflecting the last N states. A musical tone signal is processed in accordance with the generated random numbers before tone generation. It is therefore possible to generate musical tones having fluctuation close to the natural one.

The present invention is not limited to the above embodiments, and may be modified within the scope of the present invention.

What is claimed is:

1. A fluctuation generator for use in an electronic musical instrument comprising:

uniform random generating means for generating a first random number comprising a sequence of multiple bits having a uniform probability distribution over a predetermined interval; and a function circuit for receiving said first random number from said uniform random generating means and altering the probability distribution thereof to produce a second random number having a probability distribution according to a predetermined function, whereby a tone signal is processed with the second random number to produce a fluctuation in accordance with said second random number.

2. A fluctuation generator according to claim 1, wherein said uniform random generating means has a shift register for generating the first random number having a uniform probability distribution.

3. A fluctuation generator according to claim 2, wherein said uniform random generating means performs a shift operation with an exclusive NOR output of a predetermined two bits of said shift register as a shift input.

4. A fluctuation generator according to claim 1, wherein said function circuit includes a read only memory (ROM) which stores data for forming said predetermined function and outputs random number data having a probability distribution according to said predetermined function, with said first random number from said uniform random generating means used as an address input.

5. A fluctuation generator for use in an electronic musical instrument comprising:

memory means for storing a first random number for selecting one of multiple functions;

uniform random generating means for generating a second random number comprising a sequence of multiple bits having a uniform probability distribution over a predetermined interval; and a function circuit for receiving said first random number from said memory means and said second random number from said uniform random generating means, and altering the probability distribution thereof to produce a third random number having a probability distribution according to one function of a plurality of functions selected in response to said random number output from said memory means, whereby a tone signal is processed with the third random number to produce a fluctuation in accordance with said third random number.

6. A fluctuation generator according to claim 5, wherein said uniform random generating means has a shift register for generating a second random number having a uniform probability distribution.

7. A fluctuation generator according to claim 6, wherein said uniform random generating means performs a shift operation with an exclusive NOR output of a predetermined two bits of said shift register as a shift input.

8. A fluctuation generator according to claim 5, wherein said function circuit includes a read only memory (ROM) receptive of said first random number from said memory means as an address input to select one function, and outputs random number data having a probability distribution according to said selected one function, with said second random number from said uniform random generating means used as an address input.

9. A fluctuation generator according to claim 5, wherein the content of said memory means is sequentially updated by the output of said function circuit.

10. A fluctuation generator for use in an electronic musical instrument comprising;

N (N: an arbitrary integer) memory means connected in a series-shiftable manner for storing random numbers for selecting one of multiple functions;

uniform random generating means for generating a first random number comprising a sequence of multiple bits having a uniform probability distribution over a predetermined interval; and a function circuit for receiving N random numbers from said N memory means and said first random number from said uniform random generating means, and altering the probability distribution thereof to produce a second random number having a probability distribution according to said one function selected by said random numbers output from said N memory means, whereby a tone signal is processed to have function in accordance with said second random number from said function circuit.

11. A fluctuation generator according to claim 10, wherein said uniform random generating means has a shift register for generating the first random number having a uniform probability distribution.

12. A fluctuation generator according to claim 11, wherein said uniform random generating means performs a shift operation with an exclusive NOR output of a predetermined two bits of said shift register as a shift input.

13. A fluctuation generator according to claim 10, wherein said function circuit comprises a read only memory (ROM which stores data for forming multiple functions, selects one function using said random numbers from said N memory means as an address input, and outputs random number data having a probability distribution according to said selected function, with said first random number from said uniform random generating means used an address input.

14. A fluctuation generator comprising:

means for generating a first random number comprising a sequence of multiple bits having a uniform probability distribution over a predetermined interval;

means for altering the probability distribution of the first random number according to a predetermined function for producing a second random number; and means for processing a tone signal with the second random number to produce a fluctuation in the tone signal in accordance with the second random number.

15. A fluctuation generator according to claim 14, wherein the altering means comprises means for storing a previously produced second random number, and means for producing a second random number in response to the first random number and the stored previously produced second random number.

16. A fluctuation generator according to claim 15, wherein the means for producing a second random number in response to the first random number and the stored previously produced second random number comprises means for storing data corresponding to probability distributions of a plurality of predetermined functions and responsive to the stored previously produced second random number to select one of the plurality of predetermined functions and responsive to the first random number for producing a second random number according to the selected one of the plurality of predetermined functions.

17. A fluctuation generator according to claim 14, wherein the altering means comprises a memory receptive of the first random number as an address.

18. A fluctuation generator according to claim 15, wherein the altering means comprises a memory receptive of the first random number and the stored previously produced second random number as an address.

19. A fluctuation generator according to claim 14, wherein the means for generating the first random number comprises a shift register.

20. A fluctuation generator according to claim 19, wherein the shift register has a Exclusive-NOR output of a predetermined two bits as a shift input.

21. A fluctuation generator comprising:

means for generating a first random number comprising a sequence of multiple bits having a uniform probability distribution over a predetermined interval;

means for altering the probability function of the first random number to produce a second random number having a probability distribution according to a predetermined function, the means for altering comprising means for storing a previously produced second random number and means for producing a second random number in response to the first random number and the stored previously produced second random number; and means for processing a tone signal with the second random number to produce a fluctuation in the tone signal in accordance with the second random number of a predetermined two bits as a shift input.

22. A fluctuation generator according to claim 21, wherein the altering means comprises means for storing data corresponding to probability distributions of a plurality of predetermined functions and responsive to the stored previously produced second random number to select one of the plurality of predetermined functions and responsive to the first random number for producing a second random number according to the selected one of the plurality of predetermined functions.

23. A fluctuation generator according to claim 22, wherein the storing means comprises a memory receptive of the first random number and the stored previously produced second random number as an address.

24. A fluctuation generator according to claim 21, wherein the means for generating the first random number comprises a shift register.

25. A fluctuation generator according to claim 24, wherein the shift register has an Exclusive-NOR output of a predetermined two bits as a shift input.

* * * * *